US005809730A

United States Patent [19]

Renz

[11] Patent Number: 5,809,730

[45] Date of Patent: Sep. 22, 1998

[54] MOUNTING SYSTEM, ESPECIALLY GRID-TYPE CEILING SYSTEM, FOR CLEAN ROOMS

[75] Inventor: Manfred Renz, Ditzingen, Germany

[73] Assignee: Meissner + Wurst GmbH + Co. Lufttechnische Anlagen Gebaude- und Verfahrenstechnik, Stuttgart, Germany

[21] Appl. No.: 780,464

[22] Filed: Jan. 8, 1997

[30] Foreign Application Priority Data

Jan. 8, 1996 [DE] Germany ..... 29600210 U

[51] Int. Cl.[6] ..... E04B 5/52

[52] U.S. Cl. ..... 52/506.09; 52/506.07; 52/506.06; 52/506.08; 52/220.6; 52/475.1; 52/665

[58] Field of Search ..... 52/506.09, 506.06, 52/506.07, 506.08, 220.6, 220.8, 355, 665, 508, 475.1

[56] References Cited

U.S. PATENT DOCUMENTS

| | | | |
|---|---|---|---|
| 3,708,927 | 1/1973 | Cohen | 52/220.6 X |
| 3,807,114 | 4/1974 | Ollinger | 52/506.07 |
| 4,599,831 | 7/1986 | Magaha, Jr. | 52/506.07 X |
| 4,640,064 | 2/1987 | Goodworth, II | 52/506.08 |
| 4,710,208 | 12/1987 | Ziemer et al. | 52/506.08 X |
| 4,736,564 | 4/1988 | Galley | 52/506.07 |
| 4,769,965 | 9/1988 | Shaub | 52/506.07 |
| 4,937,994 | 7/1990 | Ritter | 52/506.07 |
| 4,967,530 | 11/1990 | Clunn | 52/506.08 |
| 4,986,050 | 1/1991 | Brunetti et al. | 52/506.08 |
| 5,033,247 | 7/1991 | Clunn | 52/506.08 |
| 5,279,632 | 1/1994 | Deuler et al. | 52/506.06 X |

*Primary Examiner*—Christopher Kent
*Assistant Examiner*—Yvonne Horton-Richardson
*Attorney, Agent, or Firm*—Robert W. Becker & Associates

[57] ABSTRACT

A mounting system for mounting filter-fan units in a clean room has support rails arranged at the ceiling of the clean room in a grid structure that provides receiving openings for the filter-fan units. The support rails have support surfaces for the filter-fan units, wherein opposing ones of the support surfaces define the receiving openings. Support members are placed onto the support surfaces so as to project into the receiving openings. The receiving openings have at least one of the support members placed onto at least two opposing ones of the support surfaces, respectively, for supporting the filter-fan units thereon.

15 Claims, 1 Drawing Sheet

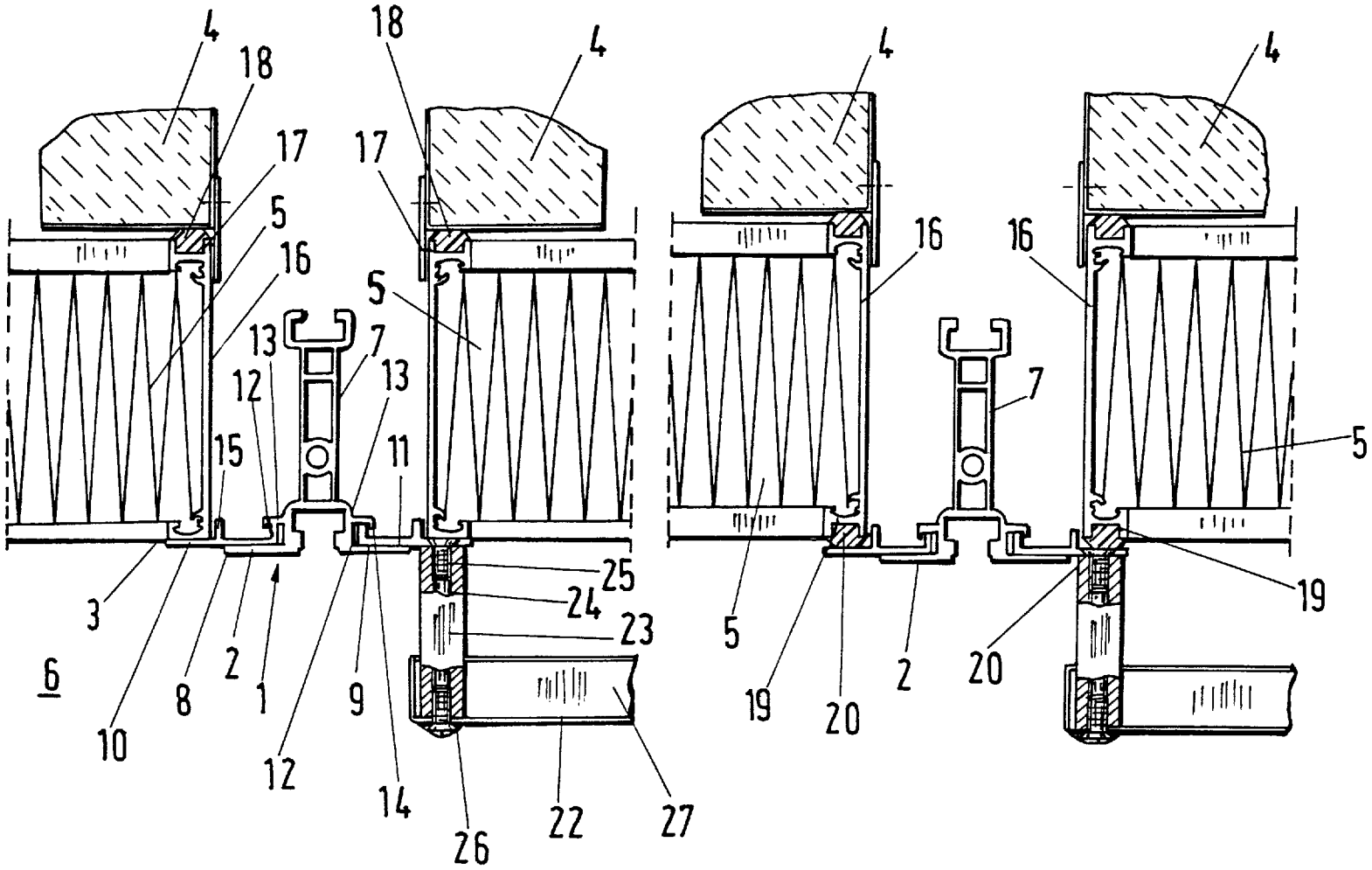
4
5
19
16
7
20
2
4
16
20
19
5
4
27
25
23
24
22
26
18
17
5
7
13
11
14
9
12
1
2
8
10
3
6
4
18
17
5
16
13
12
15

MOUNTING SYSTEM, ESPECIALLY GRID-TYPE CEILING SYSTEM, FOR CLEAN ROOMS

BACKGROUND OF THE INVENTION

The present invention relates to a mounting system, especially a grid-type ceiling system, for a clean room. The mounting system includes comprising receiving openings for mounting therein filter-fan units that are supported on support rails of the mounting system. It is known to mount filter-fan units with a mounting frame on mounting systems. The mounting system, in general, is a grid-type ceiling system that is comprised of connecting point members and profiled rails extending therebetween. The mounting frame is expensive to manufacture and requires a complicated mounting of the filter-fan units. At the underside of the filter-fan unit a filter is mounted that is directly placed onto the support rails of the mounting system. The mounting of such filters for a clean room is not possible, or possible only with difficulty, from the interior of the clean room which are to be provided adjacent to the sidewalls of the clean room in corresponding grid receiving openings. The receiving opening must in this case have a rectangular contour so that the filter in a first position can be inserted from below through the receiving opening and in second position can be placed from above onto the support rails. When the receiving opening has a square contour, the filter can only be mounted from above. However, this is only possible when in the area above the mounting system a corresponding free space is provided.

It is therefore an object of the present invention to embody a mounting system of the aforementioned kind such that the filter-fan units and the filter can be mounted from the interior of the clean room in a simple manner without having to provide in the area above the mounting system a correspondingly high free space.

SUMMARY OF THE INVENTION

The mounting system for mounting filter-fan units in a clean room according to the present invention is primarily characterized by:

Support rails arranged at a ceiling of a clean room in a grid structure providing receiving openings for the filter-fan units;

The support rails having support surfaces for the filter-fan units, wherein opposing ones of the support surfaces define the receiving openings;

Support members placed onto the support surfaces so as to project into the receiving opening;

The receiving openings having at least one of the support members placed onto at least two opposing ones of the support surfaces, respectively, for supporting the filter-fan units thereon.

Advantageously, the support members are stays.

Preferably, the support members have at least one abutment, and the support rails have at least one counter abutment. The at least one abutment rests at the at least one counter abutment.

The abutment is preferably an upwardly extending edge of the support member.

The counter abutment may be a stay member spaced from the support surface.

The abutment preferably abuts the underside of the stay member.

The abutment has a height identical to the distance between the underside of the stay member and the support surface.

The stay member has at least one securing member for the abutment.

The securing member preferably is an angled edge of the stay member. The angled edge has a free end directed toward the support surface.

The support members have at least one centering element for the filter-fan units.

The at least one centering element is advantageously provided within the receiving opening.

The centering element may be an upwardly extending web.

The mounting system advantageously further comprises cover elements attached to the support members.

A filter including a frame may be positioned below the filter-fan unit so that the frame of the filter rests on the support members.

According to the inventive mounting system, support members, advantageously stays, are provided for supporting the filter-fan units on the support rails. The filter-fan unit is inserted through the receiving opening from the interior of the clean room. Subsequently, the support members are placed onto the support rails. The lifted filter-fan unit can then be lowered until it is supported directly or indirectly (via the filter) on the support members. The support members project into the cross-sectional area of the receiving opening so that the filter-fan unit can be securely supported. During mounting the filter-fan unit must only be lifted in the upward direction through the receiving opening to such an extent that the support members can be placed onto the support rails. Thus, in the area of the mounting system there is no need for providing a tall mounting space. The height of the mounting space must only be slightly larger than the height of the filter-fan unit and optionally of a filter positioned between filter-fan unit and the support rails.

BRIEF DESCRIPTION OF THE DRAWING

The object and advantages of the present invention will appear more clearly from the following specification in conjunction with the accompanying drawing, in which the only drawing shows schematically the mounting system for a clean room ceiling.

DESCRIPTION OF PREFERRED EMBODIMENTS

The present invention will now be described in detail with the aid of a specific embodiment utilizing the only FIGURE.

The clean room ceiling which is schematically represented in the drawing has a frame-like ceiling construction, i.e., mounting system, 1 with perpendicularly crossing profiled support rails which, in a manner known per se, are connected to one another with non-represented connecting point members. The profiled support rails 2 and the connecting point members define rectangular or square receiving openings 3 for filter-fan units 4 supported in a manner which will be described in the following on the ceiling construction 1. Since the filter-fan units 4 are known per se, they will not be explained in detail in the instant specification. Below the filter-fan units 4 a filter 5 is arranged in a manner known per se through which the clean air sucked in by the unit 4 must flow before entering the clean room 6. Such filters 5 are also known and will therefore not be described here.

The ceiling construction 1 can be suspended from the ceiling of a clean room. However, it is also possible to support the ceiling construction 1 on the floor of the clean room 6. In the embodiment of the ceiling construction 1 represented in the drawing the profiled support rails 2 and/or the connecting point members are provided with upwardly extending profiled members 7 to which can be connected, in a manner known per se and not represented, cables, wires etc. for suspending the ceiling construction 1 from the ceiling of the clean room 6. The profiled members 7 are advantageously unitary parts of the profiled support rails and/or the connecting point members.

The profiled support rails 2 are provided with opposed support legs having support surfaces 8, 9 at the same level. The legs delimit the receiving opening 3. Onto the horizontally extending support surfaces 8, 9 a respective support member 10, 11 is placed. The support members 10, 11 extend past the respective support surface 8, 9 into the receiving opening 3. At one longitudinal edge the support member 10, 11 has an upwardly extending abutment 12 which abuts, in the mounted position, the underside of a counter abutment 13 of the respective profiled support rail 2. The counter abutment 13, preferably a stay member, is positioned at a distance above the support surfaces 8, 9 and extends parallel thereto. Since the counter abutments only serve to support the support members 10, 11 they can be shorter transverse to the longitudinal direction of the profiled support rail 2 than the support surfaces 8, 9. The angled edge 14 of the counter abutment 13 is angled toward the support surfaces 8, 9 and provides a securing member for the respective support members 10, 11. Due to the angled design of the edge 14 an accidental disengagement of the support members 10, 11 from the counter abutment 13 is prevented.

The support members 10, 11 further comprise a centering element 15 positioned at a distance from the abutment 12 and extending parallel thereto. It serves to center the filter 5 in the mounted position. The centering element 15 may have the same height of the abutment 12 of the support members 10, 11. In the mounted position, the centering element 15, which may be in the form of a web, is substantially positioned at the same level as the free edge of the support members 10, 11.

The filter 5 rests with its surrounding frame 16 on the respective support members 10, 11. The cross-sectional area of the filter 5 is smaller than the cross-sectional area of the respective receiving opening 3. Since the support members 10, 11 project past the support surfaces 8, 9 into the free cross-sectional area of the receiving opening 3, the filter 5 is reliably supported on the support members 10, 11. The centering elements 15 of the support members 10, 11 serve to center the respective filter 5 within the receiving opening 3. The filter-fan units 4 have a smaller cross-sectional area than the respective receiving opening 3. The filter-fan units 4 are supported via the filter 5 on the support members 10, 11. Since the support members 10, 11 with their upwardly extending free abutments 12 rest at the underside of the counter abutment 13 of the profiled support rail 2, the support members 10, 11 cannot tilt under the weight of the filter 5 and the filter-fan units 4. Thus, the units 4 and the filters 5 are reliably secured in their position when mounted. Furthermore, the downwardly oriented free ends of the angled edge 14 of the abutment 13 prevents that the support members 10, 11 can be displaced transverse to the profiled support rails 2.

The support members 10, 11 extend at least over a portion of the lengths of the respective profiled support rail 2. It is sufficient as a support for the filter-fan unit 4 and the filter 5 when the support members 10, 11 extend only over a portion of the length of the profiled support rail 2. Advantageously, all four edges of the receiving opening 3 are provided with such support members so that an optimal support of the filter-fan unit 4 with the filters 5 is ensured. In principle, it is sufficient to provide only two opposing edges, i.e., opposing support rails 2, of the receiving opening 3 with corresponding support members 10, 11. In order to prevent tilting of the units, the support members 10, 11 should have a respective greater length in this case.

The support members 10, 11 can also be in the form of angled members which are arranged in the corners of the receiving opening 3. In this case, the support of the units 4 via the filters 5 is provided at the corners of the respective receiving opening 3. It is also possible to use such angled support members 10, 11 together with the corresponding elongate support members.

When mounting the clean room ceiling, the ceiling construction 1 is first mounted and provides a grid-type ceiling with corresponding receiving openings 3. Subsequently, the filter-fan units 4 with the filters 5 can be mounted from the interior of the clean room 6 by inserting them through the receiving openings 3 in the upward direction. Subsequently, the support members 10, 11 are placed onto the support surfaces 8, 9 of the profiled support rails 2 such that their upwardly oriented abutments 12, in the manner represented in the drawing, come to rest at the underside of the counter abutment 13 of the profiled support rails 2. The downwardly extending free ends of the angular edge 14 of the counter abutment 13 are relatively short so that the support members 10, 11 can be easily brought into the mounted position by slanting them slightly. Subsequently, the units 4 and the filters 5 are lowered until the filter 5 rests with its frame 16 on the support members 10, 11 projecting inwardly (relative to opening 3) past the support surfaces 8, 9.

In this manner, the respective units 4 and filters 5 can be mounted in all of the receiving openings 3 from below. The centering element 15, that may extend over the entire length or only over a portion of the length of the support members 10, 11, serves to center the units 4 and the filter 5 so that a simple and fast assembly of the clean room ceiling is ensured. The use of screws, adhesives or other connecting means for connecting the support members 10, 11 to the profiled support rails 2 is not required so that the support members 10, 11, if needed, can be simply exchanged or replaced. The inventive clean room ceiling can also be easily disassembled, if necessary.

The frame 16 for the filter 5, in the left half of the drawing, comprises at the upper edge a profiled receiving element 17 for a seal 18. The unit 4 rests on it. The frame 16 rests with its lower edge directly on the support members 10, 11.

The filters 5 shown in the right half of the drawing are provided at the lower edge of the frame 16 with a profiled receiving element 19 for a seal 20. The filter 5 rests with the seal 20 on the support members 10, 11.

Cover elements 22 can be connected to the support members 10, 11 which cover the ceiling construction relative to the clean room 6. As shown in an exemplary fashion in the drawing, the underside of the support members 11 are provided with downwardly extending spacers 23 which are sleeve-shaped and have a continuous threaded bore 24. The spacers 23 are distributed about the surface area of the ceiling construction 1. The support members 11, in the area exterior to the profiled support rails 2, are provided with through openings for threaded bolts 25 which can be threaded from above into the threaded bore 24 of the corresponding spacer 23. The head of the threaded bolt 25 is preferably countersunk within the support member 11 so that the frame 16 of the filter 5 can be placed thereon without any obstruction by the threaded bolt 25. With the threaded bolt 25 the spacers 23 are secured at the underside of the support member 11. Into the threaded bores 24 of the spacers 23 further threaded bolts 26 are threaded with which the cover elements 22 are fastened to the underside of the spacers 23. The cover elements 22 are advantageously in the form of perforated sheet metal having a circumferential upwardly extending edge 27. The spacers 23 are positioned in the vicinity of the edge 27 within the respective perforated sheet metal 22. In the area of the threaded bolts 26 the threaded bore 24 of the spacers 23 is sealed in a suitable manner.

The air sucked in by the filter-fan units 4 flows through the filter 5 downwardly into the clean room 6 and enters the clean room 6 through the openings of the perforated sheet metal 22. The perforated sheet metal 22 can be mounted with threaded bolts 26 and can thus also be removed, if desired.

In the disclosed grid-type sealing construction 1 the filter-fan units 4 can be mounted together with the filters 5 from the interior of the clean room 6. The support members 10, 11 ensure that in all of the receiving openings 3 the filter-fan units 4 can be mounted from below. The support members 10, 11 provide simple, inexpensive components so that the clean room sealing can be produced and mounted in an inexpensive manner. The individual filter-fan units 4 can be mounted independent of one another. During mounting or demounting, the filter-fan units 4 with the filters 5 must only be lifted to such an extent that the flat support members 10, 11 can be placed onto, respectively, removed from the profiled support rails 2 in the aforedescribed manner. Thus, in the area above the grid-type ceiling construction 1 only a minimal constructive height is required.

The present invention is, of course, in no way restricted to the specific disclosure of the specification and drawings, but also encompasses any modifications within the scope of the appended claims.

What I claim is:

1. A mounting system for mounting filter-fan units in a clean room, said mounting system comprising:

support rails arranged at a ceiling of a clean room in a grid structure providing receiving openings for the filter-fan units wherein said receiving openings extend parallel to the ceiling;

said support rails having horizontal support surfaces for the filter-fan units, wherein opposing ones of said support surfaces define said receiving openings;

horizontally extending support members placed onto said support surfaces so as to project into said receiving openings;

said receiving openings having at least one of said support members placed onto at least two opposing ones of said support surfaces, respectively, for supporting the filter-fan units thereon.

2. A mounting system according to claim 1, wherein said support members are stays.

3. A mounting system according to claim 1, wherein:

said support members have at least one abutment;

said support rails have at least one counter abutment; and said at least one abutment rests at said at least one counter abutment.

4. A mounting system according to claim 3, wherein said abutment of said support member is an upwardly extending edge of said support member.

5. A mounting system according to claim 4, wherein said counter abutment is a stay member spaced from said support surface.

6. A mounting system for mounting filter-fan units in a clean room, said mounting system comprising:

support rails arranged at a ceiling of a clean room in a grid structure providing receiving openings for the filter-fan units:

said support rails having support surfaces for the filter-fan units, wherein opposing ones of said support surfaces define said receiving openings:

support members placed onto said support surfaces so as to project into said receiving openings;

said receiving openings having at least one of said support members placed onto at least two opposing ones of said support surfaces, respectively, for supporting the filter-fan units thereon:

wherein said support members are stays:

wherein said support members have at least one abutment;

wherein said support rails have at least one counter abutment:

wherein said at least one abutment rests at said at least one counter abutment;

wherein said abutment of said support member is an upwardly extending edge of said support member:

wherein said counter abutment is a stay member spaced from said support surface;

wherein said abutment of said support member abuts an underside of said stay member.

7. A mounting system according to claim 6, wherein said abutment has a height identical to a distance between said underside and said support surface.

8. A mounting system according to claim 6, wherein said stay member has at least one securing member for said abutment.

9. A mounting system according to claim 8, wherein said securing member is an angled edge of said stay member, said angled edge having a free end directed toward said support surface.

10. A mounting system according to claim 1, wherein said support members have at least one centering element for the filter-fan units.

11. A mounting system according to claim 10, wherein said at least one centering element is provided within said receiving opening.

12. A mounting system for mounting filter-fan units in a clean room, said mounting system comprising:

support rails arranged at a ceiling of a clean room in a grid structure providing receiving openings for the filter-fan units;

said support rails having support surfaces for the filter-fan units, wherein opposing ones of said support surfaces define said receiving openings:

support members placed onto said support surfaces so as to project into said receiving openings:

said receiving openings having at least one of said support support members placed onto at least two opposing ones of said support surfaces, respectively for supporting the filter-fan units thereon:

wherein said support members have at least one centering element for the filter-fan units:

wherein said centering element is an upwardly extending web.

13. A mounting system for mounting filter-fan units in a clean room, said mounting system comprising:

support rails arranged at a ceiling of a clean room in a grid structure providing receiving openings for the filter-fan units:

said support rails having support surfaces for the filter-fan units, wherein opposing ones of said support surfaces define said receiving openings:

support members placed onto said support surfaces so as to project into said receiving openings;

said receiving openings having at least one of said support members placed onto at least two opposing ones of said support surfaces, respectively, for supporting the filter-fan units thereon, and further comprising cover elements attached to said support members.

14. A mounting system according to claim 1, wherein a filter including a frame is positioned below the filter-fan unit and wherein the frame rests on said support members.

15. A mounting system for mounting filter-fan units in a clean room, said mounting system comprising:

support rails arranged at a ceiling of a clean room in a grid structure providing receiving openings for the filter-fan units;

said support rails having support surfaces for the filter-fan units, wherein opposing ones of said support surfaces define said receiving openings;

support members placed onto said support surfaces so as to project into said receiving openings;

said receiving openings having at least one of said support members placed onto at least two opposing ones of said support surfaces, respectively, for supporting the filter-fan units thereon;

wherein said support members are stays;

wherein said support members have at least one abutment;

wherein said support rails have at least one counter abutment;

wherein said at least one abutment rests at said at least one counter abutment;

wherein said counter abutment is a stay member spaced from said support surface;

wherein said abutment of said support member abuts an underside of said stay member.

* * * * *